US006123990A

United States Patent [19]

Wiggins et al.

[11] Patent Number: 6,123,990

[45] Date of Patent: Sep. 26, 2000

[54] ANTI-STATIC LUBRICANT COMPOSITION AND METHOD OF MAKING SAME

[75] Inventors: Michael S. Wiggins; Michael J. Incorvia, both of Lansdale, Pa.; Stephen A. Fischer, Franklin, Wis.

[73] Assignee: Henkel Corporation, Gulph Mills, Pa.

[21] Appl. No.: 09/085,134

[22] Filed: May 26, 1998

[51] Int. Cl.[7] ..... B05D 3/12

[52] U.S. Cl. ..... 427/242; 442/110; 442/112; 442/168; 442/170

[58] Field of Search ..... 427/242; 442/110, 442/112, 164, 168, 170; 428/412, 480, 423.1, 523

[56] References Cited

U.S. PATENT DOCUMENTS

| | | | |
|---|---|---|---|
| 4,127,694 | 11/1978 | Murphy et al. | 428/245 |
| 4,144,122 | 3/1979 | Emanuelsson et al. | 162/158 |
| 4,217,390 | 8/1980 | Newkirk et al. | 428/395 |
| 4,241,224 | 12/1980 | Newkirk et al. | 568/619 |
| 4,273,946 | 6/1981 | Newkirk et al. | 568/625 |
| 5,324,812 | 6/1994 | Speranza et al. | 528/338 |

*Primary Examiner*—Shrive Beck
*Assistant Examiner*—Jennifer Calcagni
*Attorney, Agent, or Firm*—John E. Drach; Real J. Grandmaison; Steven J. Trzaska

[57] ABSTRACT

A process for providing a substrate with anti-static and lubricating properties by contacting the substrate with a water-soluble or water-dispersible polymer composition having hydrophobic and hydrophilic properties.

12 Claims, No Drawings

ANTI-STATIC LUBRICANT COMPOSITION AND METHOD OF MAKING SAME

FIELD OF THE INVENTION

The present invention relates to antistatic compositions having lubricating properties and their use in textile and plastics processing.

BACKGROUND OF THE INVENTION

Electrostatic charge is the result of electrification of an object such that the charge is confined to the object. Friction between two surfaces in close contact typically gives rise to electrostatic charge or static electricity.

Textiles and plastics generally have low conductivity and dissipate charge at a relatively low rate. While it has been proposed to attenuate electrostatic charge build-up on textile and plastic materials by reducing its rate of generation, friction is inherent in many plastics and textile processing operations, particularly the latter, and cannot be substantially reduced. Consequently, increasing the rate of electrostatic charge dissipation of a textile or plastic material by increasing its electrolytic conductivity through the application of internal or external antistatic agents is commonly used as a means of controlling electrostatic build-up in such materials.

External or surface antistatic agents are directly applied as a coating to the surface layer of a textile or formed plastic substrate, typically dissolved or suspended in a suitable vehicle, such as water or another solvent. Internal antistatic agents are commonly used in formed plastic substrates and are physically mixed or blended with the resin mass prior to the forming operation, e.g., spinning, drawing, molding or the like, so as to be uniformly distributed throughout the body of the finished product, including the surface layer. Internal antistatic agents generally provide a longer lasting electrostatic charge dissipative effect.

One particularly notable benefit of antistatic agents is the reduction of undesired attractive forces between static prone objects treated therewith, such as so-called "static cling". In addition, treatment with antistatic agents diminishes the hazard potential of plastic packaging and other plastic products which otherwise might result in explosion when present in areas where flammable gases are used, or in damage to charge-sensitive products exposed thereto, e.g. semiconductors.

Antistatic agents have other advantages. For example, treatment of polyester and nylon fabrics with antistatic agents has been shown to reduce fabric soiling. Static-prone plastic articles, such as packaging materials, that are treated with antistatic agents resist accumulation of dust and thus are more attractive for packaging of consumer products. Antistatic agents are also used for enhancing the receptivity of plastic surfaces to electrostatically applied coatings, e.g., in automobile production.

Various chemicals have been proposed for use as antistatic agents, including, by way of example, long-chain amines, amides and quaternary ammonium salts; esters of fatty acids and their derivatives; sulfonic acids and alkyl aryl sulfonates; polyoxyethylene derivatives; polyglycols and their derivatives; polyhydric alcohols and their derivatives; and phosphoric acid derivatives.

Particularly good antistatic effects have been obtained using antistatic compositions comprising the reaction product of a polyaminoamide having unreacted primary and secondary amine groups and a halohydrin derivative. These antistatic agents have been found to be stable and not transient when used in textile and plastics processing. That is to say, an amount of antistatic agent sufficient to provide effective electrostatic charge dissipation is retained on the surface of the coated substrate, whether textile or plastic, until processing is complete. It has been discovered, however, that the last-mentioned antistatic compositions in certain applications, develop undesirable levels of surface tackiness upon drying. In particular, in applying antistatic finishes to textile materials, tacky residue from the antistatic composition may be deposited on the textile processing equipment and interfere with normal operations.

In the processing of textiles and plastic materials, it is also very desirable to impart thereto lubricating properties, for example, to improve handling properties and processing speeds. Thus, finishing compositions are generally applied to textile fibers to improve their subsequent handling and processing. Fiber finishes play an important role in assisting the fiber producer to manufacture the product, and enable the fiber producer's customers to carry out the required yarn and fabric manufacturing processes to obtain the finished textile product. The composition and amount of finish composition applied depend in large measure upon the nature, i.e., the chemical composition of the fiber, the particular stage in the processing of the fiber, and the end use under consideration.

For example, compositions referred to as "spin finishes" are usually applied to textile fibers after extrusion. These or other finishes which may be applied to yarn prior to knitting or winding, and to fiber tows prior to or at the time of crimping, drying, cutting, drawing, roving, and spinning, or to staple fibers prior to carding, i.e., web formation, and subsequent textile operations such as yarn manufacture or preparation of nonwoven webs are commonly called secondary or over-finishes. Such finishes provide lubrication, prevent static build-up, and afford a slight cohesion between adjacent fibers.

The application of such finishes is generally accomplished by contacting a fiber tow or yarn with a solution or an emulsion. Finish compositions can also be applied to tow, yarn, or cut staple by spraying.

Acceptable finishes must fulfill a number of requirements in addition to providing desired lubricating and antistatic effects. For example, they should be easy to apply (and to remove if desired), they should have good thermal and chemical stability, they should not adversely affect the physical or chemical properties of the fibers to which they are applied and they should aid the subsequent processes to which the treated fibers are subjected, they should not leave residues on surfaces or cause toxic fumes or undesirable odors, they should rapidly wet the fiber surface, they should be water-soluble or emulsifiable or solvent-soluble, they should have good storage stability, they should be compatible with sizes, nonwoven binders and other fiber treatments, they should not attract soil or cause color changes to the fibers, they should not interact with frictional elements used in texturizing and they should not be corrosive to machine parts.

DESCRIPTION OF THE INVENTION

In accordance with this invention, it has been found that water-dispersible or water-soluble polymers having hydrophobic and hydrophilic properties are eminently useful in processing synthetic fibers of polyolefins such as polypropylene, polyesters and polyamides such as nylon. It has been found that where polymers have hydrophobic and hydrophilic properties, the hydrophilic portion of the polymer imparts anti-static properties during processing of the fibers and the hydrophobic portion of the polymer imparts lubrication properties during processing of the fibers.

More particularly, it has been found that the aforementioned properties are obtained by providing water-dispersible or water-soluble polymers comprising polyethers obtained from ethoxylated or ethoxylated-propoxylated fatty alcohols having a terminal hydrocarbon chain length of at least one carbon. Such polymers may be obtained by reacting the alkoxylated fatty alcohol with sodium hydroxide to form the sodium alkoxide derivative and then condensing this derivative with an alkyl chloride such as epichlorohydrin. In accordance with the invention, the selection of starting materials may vary and can depend on the degree of hydrophobic or hydrophilic nature desired in the polymer.

Also in accordance with the present invention, there are provided articles of manufacture including textile, thermoplastic and thermoset substrates which are treated with the composition of the invention and effectively dissipate static electricity.

The composition of the invention provides the advantages of effective dissipation of electric charge, long lasting electrostatic charge dissipative effect, internal or external application to textile or plastic substrates and effective lubrication thereto.

The composition and method of the invention are also useful for imparting a desired level of surface conductivity to formed plastic articles, such as synthetic fibers, automobile bumper parts, for electrostatically applied coating materials, resulting in good adhesion of the coating material to the treated article.

DETAILED DESCRIPTION OF THE INVENTION

As used herein, "antistatic agent" refers to a substance, or mixture of substances, added to a material, either internally or externally, to make the material static dissipative. The term "static-prone" refers to substrates that are susceptible to development of electrostatic charge, due to the way in which they are processed, or otherwise.

The antistatic and lubricating composition of the invention comprises, as its essential component, a water-dispersible or water-soluble polymer having hydrophobic and hydrophilic properties. The polymer comprises the reaction product of ethoxylated or ethoxylated-propoxylated fatty alcohols having a terminal hydrocarbon chain length of at least six carbon atoms which is reacted with sodium hydroxide to form the sodium alkoxide derivative and then condensed with an alkyl chloride.

The alkoxylated fatty alcohol may be the reaction product of a $C_1$ to $C_{16}$ fatty alcohol with up to about 32 moles of ethylene oxide per mole of alcohol, or up to about 30 moles of ethylene oxide and up to about 25 moles of propylene oxide per mole of alcohol. As earlier indicated, the alkoxylated reaction product should have a terminal hydrocarbon chain length of at least one carbon atom, preferably from about 4 to about 10 carbon atoms. The alkoxylated reaction product is reacted with an alkali metal hydroxide such as sodium hydroxide or potassium hydroxide to form an alkali metal alkoxide derivative such as the sodium or potassium alkoxide derivative which is then condensed with an alkyl chloride. The alkyl chloride may be selected from a dialkyl or higher alkylchloride, diepoxide or higher epoxide, or an alkylchlorohydrin, and is preferably, epichlorohydrin. The condensation polymers have been found to provide lubrication and anti-static properties to processed polymeric fibers, particularly polypropylene.

The condensation polymers employed in this invention are prepared by known synthesis procedures, using conventional reaction conditions, as will be exemplified herein.

Although the resulting condensation polymers can advantageously be applied as-is to static-prone substrates, various additives may be included in the reaction mixture to impart certain desirable properties to the resultant composition. The selection of appropriate additives will depend to some extent on the manner in which the condensation polymer is to be incorporated into the treated substrate. Representative additives may include standard fiber finish lubricants, such as, but not limited to, coconut oils and derivatives thereof, antivarnish agents, biocides, emulsifiers, and wetting agents. The appropriate amount of any specific additive to be included in the composition employed in the invention may readily be determined on the basis of routine testing.

The antistatic and lubricating composition may be applied to natural or synthetic textile materials or mixtures of natural and synthetic materials, e.g., nylon, polyesters, polycarbonates, polyolefins, polyurethanes, rayon, acetate, rayon-cellulosic material such as cellulose acetate-propionate, cellulose-butyrate, cotton, linen, jute, ramie, wool, mohair and glass, e.g. fiberglass and fiberglass insulation. The textile materials may take virtually any form, including individual fibers, yarns, woven materials such as fabrics, cloth, carpets, rugs and upholstery and non-woven materials such as felts, batts and mats. In the case of fiberglass strand or fiberglass insulation, the composition may be applied externally as a finish or as part of a sizing composition.

The plastic substrates in which the antistatic and lubricating compositions of the invention may be beneficially incorporated include, for example, nylon (polyamide), polycarbonate, polyphenylene oxide, polyester, polyolefins such as polypropylene, and blends thereof with various other compatible resins.

Representative examples of suitable thermoplastic materials which may be treated with the antistatic and lubricating composition of the invention include polyester/polyether, nylon/polyester, polyurethane, and filled polyester.

Examples of thermoset materials which may be treated with the antistatic and lubricating composition of the invention include linear polyethylene, alkyl polyester, and epoxy resins.

Incorporation of the antistatic and lubricating composition into any given substrate will depend on the manner of manufacturing the substrate and may include surface application via padding, immersing, roller coating, spray coating and the like. The composition may also be blended with resinous materials which thereafter undergo various forming operations, e.g., extrusion or molding, to yield the finished substrate. Of course, formed substrates may also be surface coated. For textile materials, the preferred form of application is by immersion, i.e., running the textile substrate through a bath of the antistatic and lubricating composition. The appropriate mode of application may be selected by those skilled in the art in view of the overall dimensions or geometrical configuration of the surface to be treated. In any case, the mode of application should be one which causes a reasonably uniform thickness of the antistatic and lubricating composition to be deposited on the treated surface. For flat surfaces, such as sheet or strip material, this may usually be accomplished most readily through the use of rollers or squeegees. The application temperature of the composition may vary over a wide range, but is preferably from about 5° C. to about 50° C.

The coating thickness applied to a treated substrate may vary from as a little as a molecular monolayer to any desired thickness, although generally no advantage is achieved by a thickness greater than about 20 microns, while the cost of the treatment is increased. The coating thickness for textile, thermoplastic or thermoset substrates to acquire an acceptable level of conductivity should be at least about 2 microns. In operation, processing variables will be determined based upon the desired coating thickness to be obtained.

Any excess amount of antistatic and lubricating composition is typically removed from the treated substrate. The excess may be removed by a gentle water rinse, air knife blow drying, immersion in water (with or without agitation), air pressure or ultrasound. Drying may be carried out by, for example, circulating air, infra-red oven drying, or mechanical drying. While room temperature drying may be employed, it is preferable to use elevated temperatures to decrease the amount of drying time required.

Under normal operations, it is desirable to use elevated oven temperatures, hot rollers, exothermic operations such as "drawing" the fiber, or warm air streams of velocity insufficient to disturb the wet film. From a practical standpoint, the drying temperature should be well below the softening point of the substrate undergoing surface treatment.

The lubricating properties of the composition of the invention decrease the build-up of tacky residues on equipment during the processing of textile and other materials which have been treated with the composition. Tacky residues deposited on the processing equipment from the textiles can hamper the process, hence improved lubrication has important economic benefits.

Surfaces treated by the method of the invention will readily accept an electrostatically applied coating material.

The following examples are provided to describe the invention in further detail. These examples, which set forth the best mode presently contemplated for carrying out the invention, are intended to illustrate and not to limit the invention.

COMPOSITION EVALUATIONS

As earlier indicated herein, frictional, antistatic, thermal, and wetting properties of the composition are crucial with regard to fiber performance.

Frictional properties can be readily measured by applying known amounts of finish composition to yarns under controlled conditions in the laboratory. Recognizing that laboratory measurements at best only simulate actual use conditions, they have nevertheless been found to be a reasonably good predictor of behavior. One of the well-known instruments for performing frictional measurements is the Rothschild F Meter. In the case of fiber to metal friction, the measurement is carried out by pulling a fiber between two measuring heads. A pretension is set on the first measuring head, the fiber is pulled around a metal pin having a surface of known roughness, and then passes through the second measuring head which measures the tension generated when the fiber passes around the metal pin. The output tension is measured and the coefficient of friction determined from the capstan equation $$T_2/T_1=e^{\mu\theta}$$

wherein $T_1$ and $T_2$ are the incoming and outgoing tensions respectively, $\theta$ the angle of contact in radians, and $\mu$ the coefficient of friction. The Rothschild instrument calculates and plots the coefficient of friction automatically. Some prefer to use the value of $T_2-T_1$ as a measure of the frictional force since strictly speaking the capstan equation is not accurately obeyed by compressible materials such as fibers.

There are a number of variables, both mechanical and physical, in addition to the pretension and angle of contact, which can influence friction results. Some of these are speed, surface roughness, surface temperature, ambient temperature and humidity, finish composition viscosity, uniformity of finish composition application, finish composition concentration on the fiber, and fiber size and shape. Thus, when performing laboratory frictional experiments to determine the performance of a finish composition, one should select a condition related to that which the yarn will be exposed, such as for example, frictional measurements against a heated surface.

The fiber to fiber friction measurement is carried out in a similar way except that the yarn is twisted around itself several times and the force determined to pull the yarn in contact with itself. Again, with a knowledge of the incoming tension, the angle of wrap, and the outgoing tension, the frictional coefficient can be determined. In the case of fiber to fiber friction, it is customary to distinguish between static and dynamic frictional coefficients. Static friction is determined at a low speed (on the order of 1 cm/min), and dynamic friction at a higher speed. When measuring low speed friction, a stick-slip phenomenon is sometimes observed. Stick-slip is roughly a measure of the force required to move the fiber or to overcome its inertia. It is this measurement which is most closely related to the "scroop" observed with staple fibers, or the cohesion of staple fiber web as it emerges from a card, or the performance of a finish composition in yielding a yarn package which is stable and does not slough. The stick-slip phenomenon indicates that the static friction is higher than the dynamic friction and can be affected by the behavior of boundary lubricants. The afore-mentioned measurements are useful guidelines for evaluating how a treated fiber may behave on a production line.

Antistats function by either reducing the charge generation or by increasing the rate of charge dissipation. Most antistats operate by increasing the rate of dissipation and rely on atmospheric moisture for their effectiveness. A fiber such as polypropylene depends on an antistat coating to impart high surface conductivity for charge dissipation. There are several ways to assess the antistatic activity of a finish composition. During the measurement of fiber to metal friction and the passage of yarn around the metal pin, static charges are generated. The Rothschild friction meter has an electrostatic voltmeter attachment which measures the charge generated by the moving yarn. At periodic intervals, the static is discharged and allowed to rebuild. Correlation of the charge developed in this measurement with actual performance observed under various manufacturing and use conditions is generally very good provided the relative humidity is reasonably close to the test condition.

Another method for assessing the antistatic activity of a finish composition is to measure the time for a charge to dissipate after the fiber has been charged. This is called the half-life measurement, but it is not conducted on a moving yarn. Still another technique is to measure the resistivity of a non-moving yarn using an ohm-meter capable of measuring high resistance. Theoretically, the higher the resistance, the lower the conductivity and the poorer the antistat.

The effect of aging on antistat performance can also be determined by any of these methods. Migration of the antistat from the fiber surface to the interior can occur under certain conditions with a subsequent loss of surface antistatic activity.

The effect of frictional and static properties is generally obvious throughout fiber manufacture and processing. Fiber to fiber friction is important to the fiber producer in controlling formation and stability of filament yarn packages since sloughing can occur if it is too low. Also, if fiber to fiber friction is too low, there could be problems of poor web cohesion in carding of staple fibers. On the other hand, low fiber to fiber friction is very desirable for continuous filament yarns which are used in applications such as cordage which involves twisting and plying. Low friction is desirable since it is associated with high flex resistance and high energy absorption and therefore, long life. Fiber to metal friction is also very important in many of the fiber processes. Lower fiber to metal friction is generally preferred since there is less opportunity for damage to the fibers either by abrasion or heat generation as the yarn contacts metal surfaces. The fibers and fabrics prepared by this invention, particularly polyolefins, are provided with improved properties.

The present invention will be better understood from the examples which follow, all of which are intended to be illustrative only and not meant to unduly limit the scope of the invention. Unless otherwise indicated, percentages are on a weight-by-weight basis.

EXAMPLE I

To a one liter stainless steel reactor was added 200 grams of an ethoxylated $C_{10}$ alcohol containing 4 moles of ethylene oxide available from Henkel Corporation, Charlotte, N.C. under the tradename Trycol® 5950 and 350 grams of toluene. To the reactor was attached a Dean-Stark receiver with a condenser and also an addition funnel. The contents of the reactor was heated under a nitrogen blanket to reflux to remove the ambient water. The water was collected in the Dean-Stark receiver. Care was taken that the temperature did not exceed 125° C.

The addition funnel was charged with a caustic solution which was added to the reactor over a period of about 45 minutes to one hour. Addition of the caustic solution during the first five minutes is done carefully to avoid excessive foaming. The caustic charge was calculated as follows:

$$\text{grams ethoxylated alcohol} \times \text{ethoxylated alcohol hydroxy number} \times (\text{epichlorohydrin}+0.2) \times 80 = \text{grams 50\% NaOH}$$

Collection of water was continued in the Dean-Stark receiver until all the water added during the caustic solution addition was received. The reaction mixture was refluxed for an additional hour. The moisture content of the mixture was determined by means of an Aquatester, refluxing was stopped when the moisture content was less than about 1%/wt, and the mixture was cooled to about 60° C.

A clean addition funnel was charged with epichlorohydrin to provide an epichlorohydrin/OH ratio of about 0.8. The epicholorohydrin charge was calculated as follows:

$$\text{grams ethoxylated alcohol charge} \times \text{ethoxylated alcohol hydroxyl number} \times (\text{epichlorohydrin/OH cross-link ratio}) \times 93.4 = \text{grams epichlorohydrin}$$

The epichlorohydrin was added to the reaction mixture at a rate so that the exotherm would not allow the temperature to exceed 90° C., the boiling point of epichlorohydrin. The addition was completed over about 45 minutes to an hour. The temperature of the reaction mixture was increased to about 90° C. and maintained for 1 to 2 hours. The epoxide content was titrated before raising the temperature to reflux, not to exceed 110° C. The progress of the reaction was followed by titrating the residual epoxide, and reflux was continued until the epoxide content was nil. At the nil epoxide content point the reaction mixture was cooled.

The mixture was then heated by adding hydrochloric acid to it and to remove the water by azeotrope distillation. The amount of hydrochloric acid required to neutralize the alkalinity was determined as follows:

$$\frac{\text{mls titrant (Bromo-phenol blue end-point)} \times 0.01 \times \text{total grams to be neutralized}}{\text{grams titrated sample}} = \text{grams concentrated HCl}$$

The salt produced was removed by centrifuge, and any remaining water by vacuum stripping at 110° C. If any salt sediment was observed in the sample after vacuum stripping, it was centrifuged and vacuum stripped until a clear product was obtained. The material was coded test sample Z 5363.

EXAMPLE II

The process of Example I was substantially followed to prepare a composition having an epichlorohydrin/OH ratio of about 1.1. The material was coded test sample Z 5503.

EXAMPLE III

The process of Example I was substantially followed except that the starting material was an ethoxylated $C_4$ alcohol containing 3 moles of ethylene oxide available from Union Carbide Corp. as butoxytrigol to prepare a composition having an epichlorohydrin/OH ratio of about 0.8. The material was coded test sample Z 5364.

EXAMPLE IV

The process of Example III was substantially followed to prepare a composition having an epichlorohydrin/OH ratio of about 1.1. The material was coded test sample Z 5504.

A series of alkoxylated alcohols having various carbon chain lengths and containing various moles of ethylene oxide were also evaluated as described in the following. The products were evaluated for fiber/metal, fiber/fiber, stick-slip and static properties at 0.1% and 0.5%/wt finish on yarn (FOY) on 150/34 fully drawn PET. PET stands for polyester terephthalate. "150/34 fully drawn PET" means that when the polyester is fully drawn, 34 filaments make up a bundle that is 150 denier. Polyester chip is melted and extruded through a spinnerette having 34 holes. As it is pulled from the spinnerette, while solidifying, the size of the filament bundle shrinks, similar to a rubber band being stretched. The polyester polymer molecules start going from an amorphous mass to being oriented, i.e., stretched out. Fiber producers sell POY (partially oriented yarn) that has some stretch left, so that their customers can take advantage of the left-in stretch during their processing (such as texturing). "Fully drawn" means that the bundle is stretched to essentially its maximum or is fully oriented yarn.

In the following table, "% FOY" represents percent finish composition, by weight, on the dry yarn. The "% FOY" needed for processing is based on the fiber chemistry and what processing to which the fiber will be further subjected. There is general trend in the industry to use lower amounts of finish on the fiber, in particular, to reduce environmental concerns.

In the following table, F/M denotes fiber/metal friction; 100 m/min and 300 m/min denotes the speed in meters/min of the fiber over the metal guides. Static (v) denotes the voltage charge on the fiber arising from fiber passing over the metal guide, the lower the magnitude of the number the better. The sign denotes the electrical charge on the fiber, negative indicates a negative charge and the converse for positive charges. F/F denotes the friction arising from fiber rubbing against fiber. S/S denotes the stick-slip properties, indicating how much the fibers "stick" before enough tension (friction) has built-up before they are able to "slip" and slide over one another.

The following coded products shown in Table I were evaluated:

Z 5929 represents a liquid nonionic surfactant having an HLB of 10.0 and a molecular weight of 930 available from BASF Corp. under the tradename Plurafac® D-25. Z 5931 represents a liquid nonionic surfactant comprising an ethoxylated straight chain alcohol having a molecular weight of 490 available from BASF Corp. under the tradename Plurafac® LF-1200. Z 5933 represents a liquid nonionic surfactant having an HLB of 7.0 and a molecular weight of 820 available from BASF Corp. under the tradename Plurafac® RA-40. Z 5935 represents a liquid nonionic surfactant having an HLB of 9.0 and a molecular weight of 625 available from BASF Corp. under the tradename Plurafac® RA-30. Z 5937 represents a liquid nonionic surfactant having an HLB of 10.0 and a molecular weight of 790 available from BASF Corp. under the tradename Plurafac® RA-20. Z 5939 represents an ethoxylated alcohol liquid nonionic surfactant having a molecular available from BASF Corp. under the tradename Plurafac® LF-700. Z 5941 represents an ethoxylated alcohol liquid nonionic surfactant having a molecular weight of 570 available from BASF Corp. under the tradename Plurafac® LF-3140.

Z 5363 represents a $C_{10}$ alcohol containing 4 moles of ethylene oxide having an epichlorohydrin/OH (Epi/OH) cross-link ratio of 0.8. Z 5364 represents a $C_4$ alcohol containing 3 moles of ethylene oxide having an Epi/OH cross-link ratio of 0.8. Z 5503 represents a $C_{10}$ alcohol containing 4 moles of ethylene oxide having an Epi/OH cross-link ratio of 1.1. Z 5504 represents a $C_4$ alcohol containing 3 moles of ethylene oxide having an Epi/OH cross-link ratio of 1.1. 50-HB-170 represents Ucon 50-HB-170 that is a random ethylene oxide/propylene oxide adduct on butanol having a molecular weight of 270 and a pour point of −45° F. available from Union Carbide Corp. 50-HB-260 represents Ucon 50-HB-260 that is an alkoxylated diethylene glycol monobutyl ether having a molecular weight of about 1,000 and an ethylene oxide/propylene oxide weight ratio of 50/50 available from Union Carbide Corp. 50-HB-660 represents Ucon 50-HB-660 that is a random ethylene oxide/propylene oxide adduct on butanol having an average molecular weight of about 1,600 available from Union Carbide Corp. EPB 260 represents Synalox EPB 260 that is an alkoxylated dipropylene glycol monobutyl ether having a molecular weight of about 1,000 and an ethylene oxide/propylene oxide weight ratio of 50/50 available from Dow Chemical Company.

TABLE I

| Sample ID | F/M (cN) 100 m/min | STATIC (V) 100 m/min | F/M (cN) 300 m/min | STATIC (V) @ 1 min | F/F (cN)** 25 m/min | S/S (c/N)*** 0.5 cm/min |
|---|---|---|---|---|---|---|
| Control (Ucon 50-HB-260) | 105.84 | −160 | 129.96 | −140 | 34.40 | 9.76 |
| Z5929 (0.25% foy) | 92.60 | −70 | 110.84 | −5 | 34.40 | 5.67 |
| Z5931 (0.25% foy) | 86.24 | −120 | 109.36* | −160 | 33.00 | 10.40 |
| Z5933 (0.25% foy) | 118.16 | −80 | 146.92 | −25 | 32.04 | 8.20 |
| Z5935 (0.25% foy) | 102.52 | −115 | 128.92 | −60 | 32.92 | 8.15 |
| Z5937 (0.25% foy) | 115.44 | −120 | 132.40 | −50 | 41.92 | 6.95 |
| Z5939 (0.25% foy) | 111.96 | −85 | 126.92 | +75 | 22.96 | 6.31 |
| Z5941 (0.25% foy) | 89.88 | −75 | 113.24 | −25 | 23.52 | 8.86 |
| Z5363 @ 0.1% foy | 100.56 | −350 | 107.88 | −1000 | 54.91 | 3.12 |
| Z5363 @ 0.5% foy | 75.99 | −350 | 89.48 | −500 | 53.01 | 1.91 |
| Z5364 @ 0.1% foy | 72.84 | −225 | 90.80 | −550 | 48.84 | 2.88 |
| Z5364 @ 0.5% foy | 62.32 | −200 | 82.84 | −800 | 48.83 | 6.26 |
| Z5503 @ 0.1% foy | 90.32 | −1000 | 87.38 | −2000 | 52.75 | 1.77 |
| Z5503 @ 0.5% foy | 97.04 | −500 | 115.00 | −850 | 63.02 | 0.95 |
| Z5504 @ 0.1% foy | 77.27 | −1400 | 92.40 | −2600 | 52.12 | 1.30 |
| Z5504 @ 0.5% foy | 73.20 | −850 | 81.40 | −2700 | 52.68 | 0.00 |
| 50-HB-170 @ 0.1% foy | 61.08 | −115 | 71.00 | −125 | 47.39 | 5.15 |
| 50-HB-170 @ 0.5% foy | 55.76 | −75 | 71.32 | +300 | 45.56 | 8.50 |
| 50-HB-260 @ | 69.52 | −85 | 83.92 | −250 | 49.58 | 4.86 |

TABLE I-continued

| Sample ID | F/M (cN) 100 m/min | STATIC (V) 100 m/min | F/M (cN) 300 m/min | STATIC (V) @ 1 min | F/F (cN)** 25 m/min | S/S (c/N)*** 0.5 cm/min |
|---|---|---|---|---|---|---|
| 0.1% foy | | | | | | |
| 50-HB-260 @ 0.5% foy | 62.44 | +100 | 73.64 | +450 | 49.34 | 7.68 |
| 50 HB-660 @ 0.1% foy | 66.32 | +75 | 72.44 | +350 | 47.04 | 4.54 |
| 50-HB-660 @ 0.5% foy | 67.20 | +200 | 74.20 | +800 | 50.77 | 5.34 |
| EPB260 0.1% foy | 56.00 | −10 | 67.88 | +375 | 47.65 | 6.10 |
| EPB260 0.5% foy | 60.40 | −30 | 76.00 | +600 | 47.66 | 7.73 |

In the above data, "cN" represents centi-newton as a measure of lubricity wherein low friction values are desirable. As to the static volt values, a value as close to zero as possible is also desirable.

While it is apparent that the various embodiments of the invention disclosed and exemplified are well suited to fulfill the above-stated objects, it will be appreciated that the invention is susceptible to modifications, variations and change without departing from the spirit of the invention, the full scope of which is delineated by the appended claims.

What is claimed is:

1. The process of providing a substrate selected from the group consisting of textile, plastics, and mixtures thereof with anti-static and lubricating properties, comprising contacting said substrate with a water-soluble or water-dispersible polymer composition having hydrophobic and hydrophilic properties, wherein said polymer composition comprises a polyether obtained from ethoxylated or ethoxylated-propoxylated fatty alcohols having a terminal hydrocarbon chain length of at least one carbon atom wherein said polyether has been reacted with an alkali metal hydroxide to form the alkali metal alkoxide derivative which is then condensed with an alkyl chloride.

2. A process as in claim 1 wherein said alkyl chloride comprises epichlorohydrin.

3. A process as in claim 1 wherein said polyether is the reaction product of a $C_1$ to $C_{16}$ fatty alcohol with up to about 32 moles of ethylene oxide per mole of said alcohol.

4. A process as in claim 1 wherein said polyether is the reaction product of a $C_1$ to $C_{16}$ fatty alcohol with up to about 30 moles of ethylene oxide and up to about 25 moles of propylene oxide per mole of said alcohol.

5. A process as in claim 1 wherein said fatty alcohols have a terminal hydrocarbon chain length of from about 4 to about 10 carbon atoms.

6. A process as in claim 1 wherein said alkali metal hydroxide is selected from the group consisting of sodium hydroxide and potassium hydroxide.

7. A process as in claim 1 wherein said alkyl chloride is selected from the group consisting of a dialkyl or higher alkyl chloride, diepoxide or higher epoxide, alkylchlorohydrin, and epichlorohydrin.

8. A process as in claim 1 wherein said polymer composition further contains an additive selected from the group consisting of a fiber lubricant, an anti-varnish agent, a biocide, an emulsifier, a wetting agent, and mixtures thereof.

9. A process as in claim 1 wherein said substrate comprises a natural or synthetic textile material or mixture thereof.

10. A process as in claim 1 wherein said substrate comprises a substrate selected from polyamides, polycarbonates, polyesters, polyolefins, polyurethanes, and mixtures thereof.

11. A process as in claim 1 wherein said contacting of said substrate is conducted by padding, immersing, roller coating or spray coating said substrate.

12. A process as in claim 1 wherein said polymer composition is applied to said substrate to provide a coating thickness of from a molecular monolayer to about 20 microns.

* * * * *